US005081822A

United States Patent [19]

Boyd et al.

[11] Patent Number: 5,081,822

[45] Date of Patent: Jan. 21, 1992

[54] AUTOMATIC CAPLET FILLER

[75] Inventors: William G. Boyd; Willis E. Barns, Jr., both of Greenwood; Ray B. Turner, Jr., Ninety Six, all of S.C.

[73] Assignee: Warner-Lambert Company, Morris Plains, N.J.

[21] Appl. No.: 473,290

[22] Filed: Feb. 1, 1990

[51] Int. Cl.[5] ..... B65B 43/40; B65B 7/28; B65B 43/50; B65B 43/60

[52] U.S. Cl. ..... 53/468; 53/471; 53/485; 53/492; 53/281; 53/299; 53/900

[58] Field of Search ..... 53/900, 381 A, 236, 53/151, 247, 468, 492, 454, 560, 471, 485, 299, 390, 281

[56] References Cited

U.S. PATENT DOCUMENTS

| | | | |
|---|---|---|---|
| 899,761 | 9/1908 | Remington | 53/900 X |
| 2,108,906 | 2/1938 | Speckhart et al. | 53/900 X |
| 3,070,932 | 1/1963 | Höfliger | 53/900 X |
| 3,538,677 | 11/1970 | Amoroso et al. | 53/900 X |
| 3,552,095 | 1/1971 | Inman | 53/900 X |
| 4,627,225 | 12/1986 | Faller et al. | 53/560 X |
| 4,884,602 | 12/1989 | Yamamoto et al. | 53/560 X |

*Primary Examiner*—Horace M. Culver
*Attorney, Agent, or Firm*—Daniel A. Scola, Jr.

[57] ABSTRACT

An automatic capsule filling apparatus includes a body holding ring and a superposed cap holding ring mounted on a ring carrier. The body holding ring includes rows of body cavities for holding a body portion of a capsule. A vacuum line is connected to an orifice in the bottom of each body cavity for retaining capsule body portions. The cap holding ring is superposed thereover and has corresponding cap cavities for receiving preassembled capsules. The cap holding ring includes a lip for engaging the cap portion when the cap holding ring is lifted from the vacuum-retained body holding ring, thereby removing the cap. The preassembled capsules are properly oriented and inserted into the rings row-by-row by a capsule rectifier. Once the rings are filled with capsules, the body holding ring vacuum is utilized to retain the capsule body portions, and the cap holding ring is lifted from the body holding ring to remove the caps from all of the preassembled empty capsules. The body holding ring is then placed on an incremental rotary table positioned beneath a caplet hopper having juxtaposed chutes for filling the empty body portions with caplets. Once filled, the cap holding ring containing the empty cap portions and the body holding ring containing the caplet filled body portions are closed together in a capsule closing assembly. The caplet filled capsules are then expelled from the cap holding assembly and fall into a vibrator feeder cleaner for subsequent packaging.

16 Claims, 4 Drawing Sheets

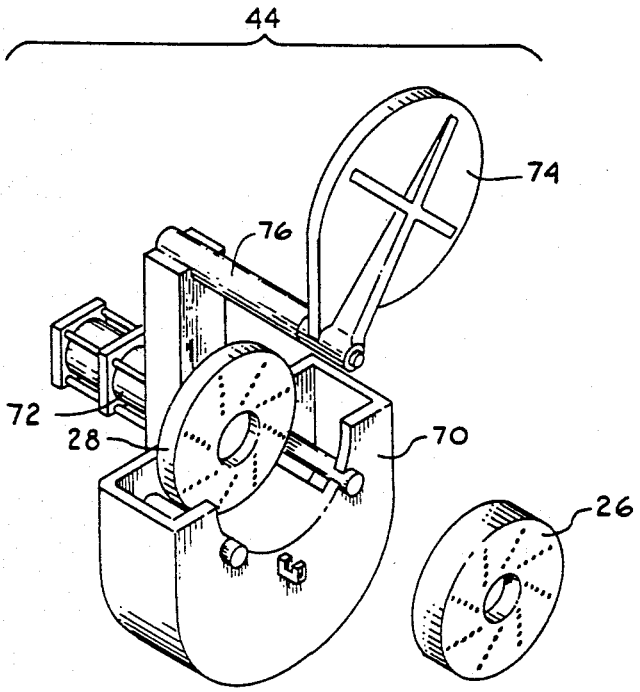
Fig. 7
Fig. 8A
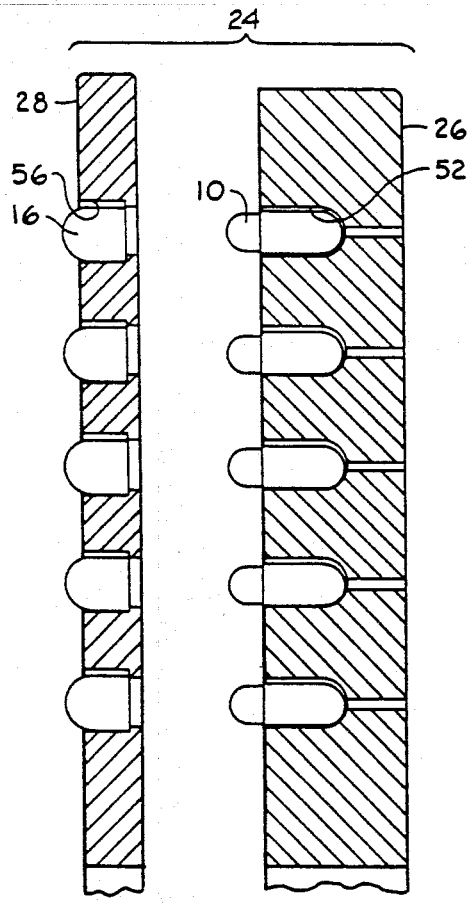
Fig. 8B
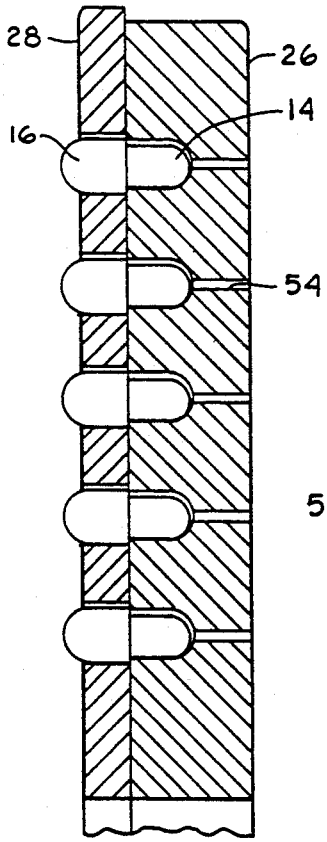
Fig. 8C
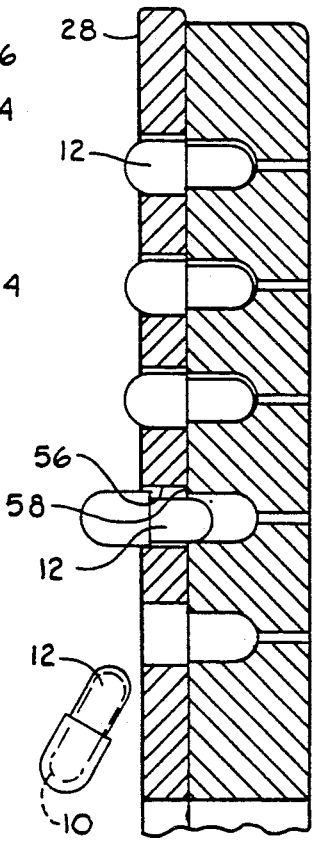

AUTOMATIC CAPLET FILLER

FIELD OF THE INVENTION

This invention relates generally to apparatus for automatically filling an empty capsule with a medicament. More specifically, this invention relates to an apparatus which fills preassembled, empty, gelatin capsules with a caplet formed medicament. The present invention is particularly, though not exclusively useful for automatically filling gelatin capsules with a caplet.

BACKGROUND OF THE INVENTION

Over the years, devices have been developed for automatically filling capsules for use in the pharmaceutical field. In particular, it has been found that a two-piece gelatin shell covering the pharmaceutical enhances patient acceptance. In addition, it enhances ease of swallowing and is a convenient and attractive manner of packaging various pharmaceuticals.

Recently, various oral medications have been manufactured in the form of caplets, which can be swallowed by patients during their regimen of taking medication. Caplets have become popular in view of the recent tampering of gelatin capsules containing powdered medicaments. However, caplets are not as easy to swallow as gelatin capsules. Accordingly, a need has arisen for filling a two-piece gelatin capsule shell with a caplet for the ease and convenience mentioned above.

The present invention recognizes the need for providing an apparatus which automatically fills a two-piece gelatin capsule with a caplet. In addition, there is a need for such an apparatus which accomplishes this function at a production rate which is sufficiently high to meet the demand therefor at a reasonable cost. In addition, there is a need for such an apparatus which is inexpensive to manufacture and yet is simple and efficient in its operation.

Accordingly, it is an object of the present invention to provide an apparatus for automatically filling an empty capsule with a caplet in an efficient manner. It is yet another object of the present invention to provide an apparatus for automatically filling a capsule with a caplet which can process a large number of capsules in a short period of time at a high production rate. It is yet another object of the present invention to provide an automated caplet filler which requires a relatively small amount of floor space area, and which is easily controlled by the operator thereof. Another object of the present invention is to provide an automated caplet filler which is convenient to use, standardized, cost effective and easily manufactured.

SUMMARY OF THE INVENTION

A preferred embodiment of an automatic caplet filling apparatus comprises a capsule rectifier which properly orients preassembled empty gelatin capsules for placement into cavities on a capsule filling ring. The capsule filling ring is comprised of a body holding ring and a superposed cap holding ring for respectively receiving the body portions and cap portions of the preassembled capsules. The body portion of the capsule is retained within the cavity of the body holding ring by a partial vacuum. While the body portion of the capsule is so held, the cap holding ring is lifted from the body holding ring thereby removing the cap portion from the body portion of the capsule. Once the cap portions have been separated from their respective body portions, the body holding ring containing the empty body portions is positioned on a rotary table to sequentially align the empty capsule body portions with a caplet filler.

The caplet filler includes a hopper for holding caplets, and has a plurality of juxtaposed chutes extending from the hopper in alignment with rows of empty capsule portions held in the cavities of the body holding ring. In operation, the body holding ring is rotated on the rotary table to sequentially bring a plurality of rows of empty capsule body portions into individual alignment with the respective chutes. Once so aligned, individual caplets from the hopper are conveyed through the chutes into the empty capsule body portions. The body holding ring is incrementally rotated row-by-row to accomplish one cycle and fill the entire ring. Then, the body holding ring carrying the caplet filled body portions, and the cap holding ring carrying the cap portions, are placed together on a capsule closing assembly. The capsule closing assembly is then operatively engaged to close the cap holding ring onto the body holding ring to rejoin the cap and body portions and create a solid gelatin capsule filled with a caplet.

The novel features of this invention, as well as the invention itself, both as to its structure and its operation, will be best understood from the accompanying drawings, taken in conjunction with the accompanying description, in which similar reference characters refer to similar parts, and in which:

BRIEF DESCRIPTION OF THE DRAWINGS

FIG. 7 is a perspective view of a capsule closing assembly in accordance with the present invention; and FIGS. 8A, 8B and 8C are schematic representations of the operation of the capsule closing assembly, partially in cross section, in accordance with the present invention.

DESCRIPTION OF THE PREFERRED EMBODIMENT

Figure 1:
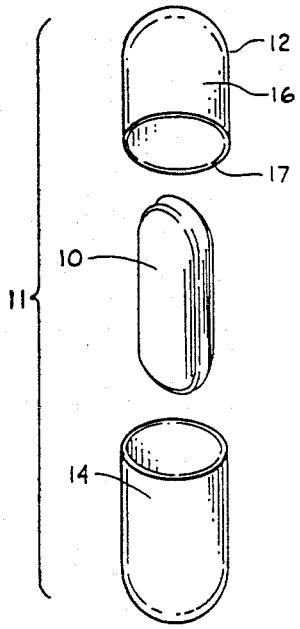
FIG. 1 is an exploded perspective view of a capsule and a caplet, the capsule having a capsule body portion separated from a capsule cap portion.

FIG. 1 shows a caplet 10 which is to be enclosed within a capsule generally indicated as 12. The caplet 10 and capsule 12 combination which is to be used with the claimed invention is bracketed in FIG. 1 and generally designated 11. Capsule 12 comprises a body portion 14 and a cap portion 16. The capsule is typically a hollow gelatin shell of a generally cylindrical shape having a diameter and length sufficient so that the caplet 10 fits appropriately in the empty capsule 12. The body portion 14 has an outside diameter which is a small amount less than the inside diameter of the cap portion 16 so that there is a proper fit of the cap portion onto the body portion. In addition, cap portion 16 has a leading edge 17 about its circumference. While reference here is primarily directed to the placement of a caplet 10 into a capsule 12, it is to understood that the present invention pertains generally to the placement of any substance into the capsule 12.

Figure 2:
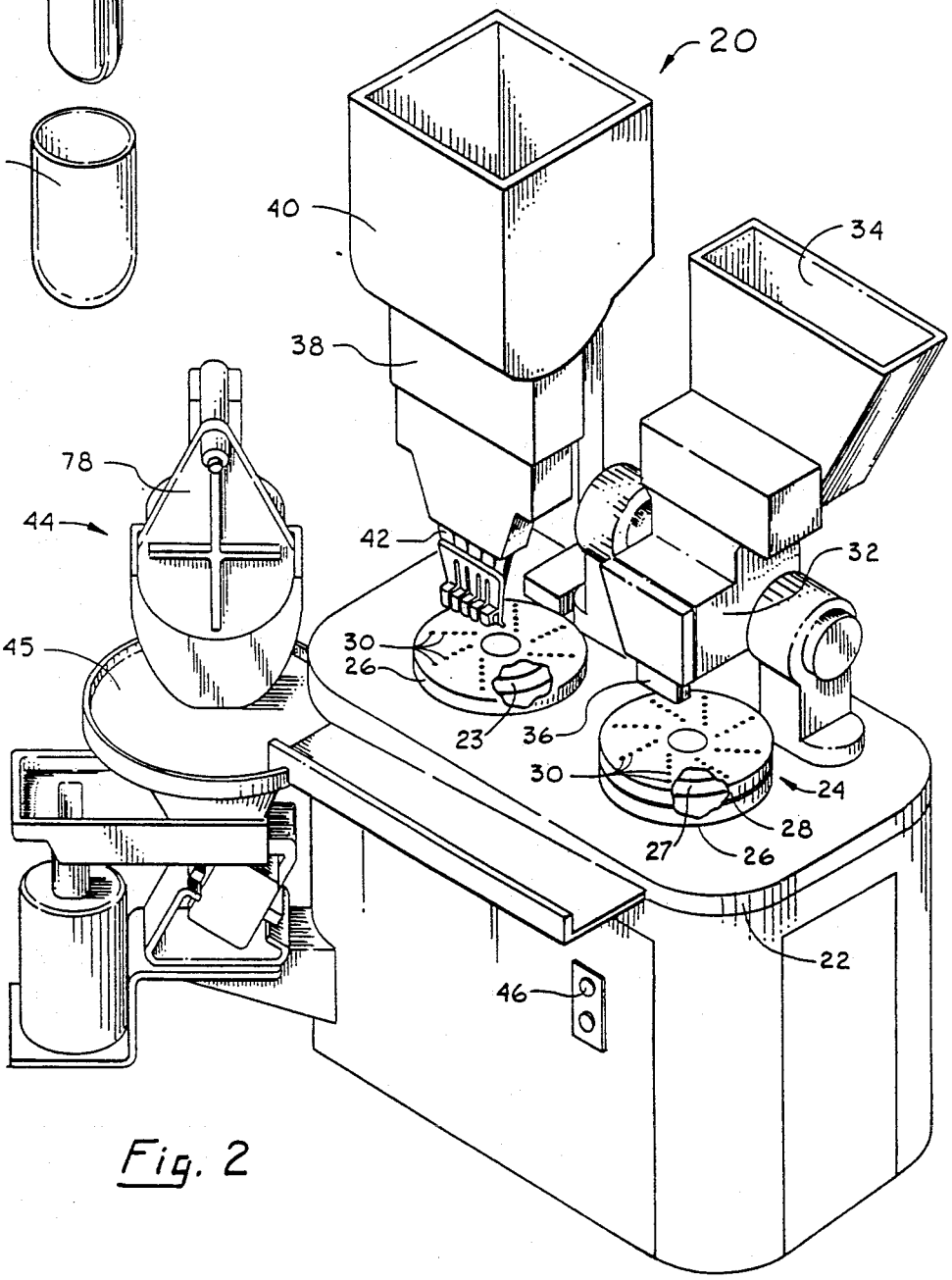
FIG. 2 is a perspective view of an automatic caplet filling apparatus in accordance with the present invention.

Referring now to FIG. 2, there is shown an automatic caplet filling apparatus generally designated 20. The automated caplet filler apparatus 20 comprises a base 22 having a rotary table 23 on which is mounted a rotatable capsule filling ring 24. Capsule filling ring 24 is comprised of a body holding ring 26 and a cap holding ring 28 superposed over the body holding ring 26. The body holding ring 26 and cap holding ring 28 are each in the shape of a thin, flat, circular plate. The cap holding ring 28 is separable from the body holding ring 26. Body holding ring 26 and cap holding ring 28 each have a series of rows of cavities 30 for receiving capsules 12, as will be more fully explained below.

Connected to base 22 is a capsule rectifier 32 having a capsule hopper 34 for containing a plurality of capsules, and capsule feeder 36. The capsule rectifier 32 properly orients preassembled empty gelatin capsules for placement into the rows of cavities 30 of the capsule filling ring 24. Adjacent the capsule rectifier 32 and connected to base 22 is a caplet filler member 38 having a caplet hopper 40 for containing a plurality of caplets. The caplet hopper 40 is connected to a plurality of juxtaposed chutes 42 extending from the caplet hopper 40. Beneath the chutes 42 is a rotatable removable body holding ring 26 also rotatably mounted on a rotary table 27 on base 22. The chutes 42 are in alignment with rows of cavities 30 on the body holding ring 26 for incremental rotation and for filling of capsules 12, as will be more fully described below.

Caplet filling apparatus 20 also includes a capsule closing assembly 44 connected to base 22 for closing capsules about the filled capsule body portion. Base 22 has mounted thereon a motor switch 46 for use by the operator of the device to control a motor (not shown) utilized to operate the device. Beneath the capsule closing assembly, there is further located a vibrator feeder cleaner 45.

Figure 3:
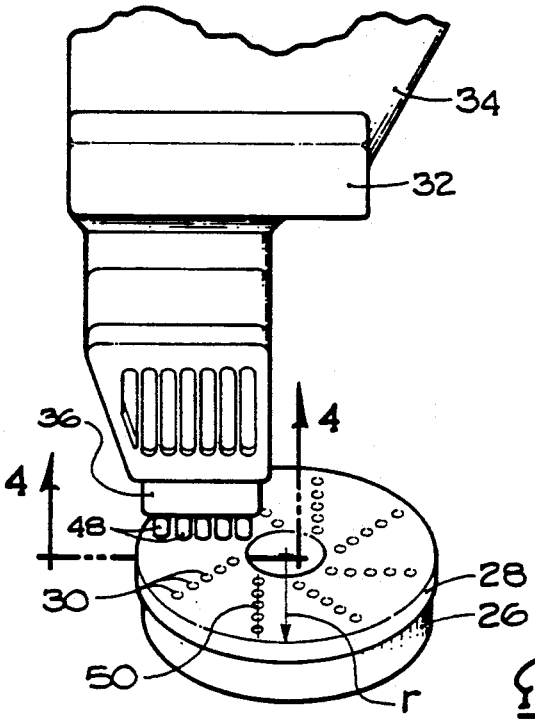
FIG. 3 is a close-up view of a capsule filling ring positioned beneath a capsule rectifier of the present invention.

Referring now to FIG. 3, there is shown a portion of the apparatus 20 of FIG. 2 including the capsule rectifier 32 and a portion of the hopper 34. The capsule feeder 36 includes a plurality of capsule feed channels 48 having a number of passages corresponding to the arrangement of cavities 30 on the cap holding ring 28 and body holding ring 26. The number of cavities 30 in each row of the arrangement shown corresponds to the number of capsule feed channels 48 for feeding a preassembled empty capsule 12 into each cavity 30 of each row 50. Preferably, each straight row 50 of cavities 30 are positioned parallel to a radius "r" of the capsule filling ring 24. However, other arrangements could be utilized provided there is a proper alignment between cavities 30 and channels 48. In addition, the body holding ring 26 and superposed cap holding ring 28 have their respective cavities 30 aligned to allow insertion of a preassembled, empty capsule 12 into the cavity. Alignment of the rings 26 and 28 may be accomplished by any means used in the art which may include simply notching each respective ring to provide a reference for positioning the rings together.

Figure 4A:
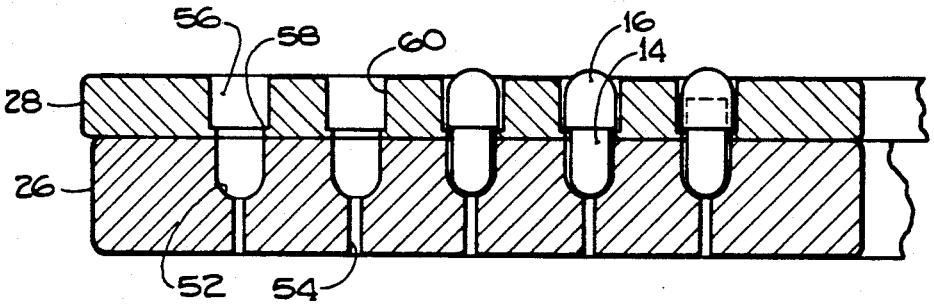
FIG. 4A is a cross-sectional view of the capsule filling ring taken along the line 4—4 of FIG. 3.
Figure 4B:
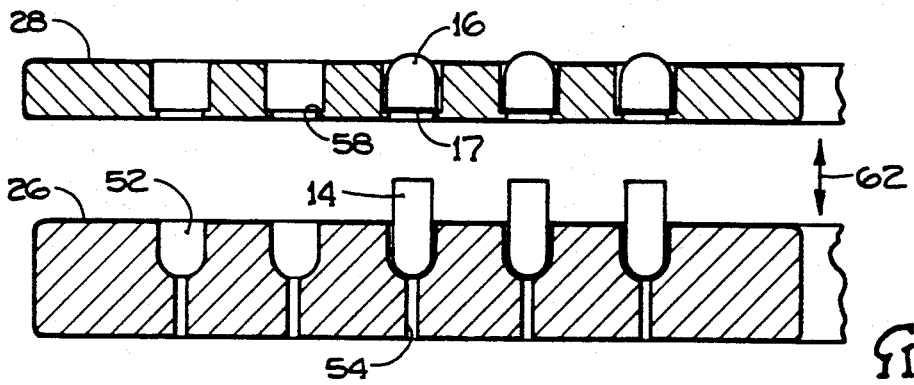
FIG. 4B is a cross-sectional view of the capsule filling ring taken along the line 4—4 of FIG. 3 illustrating removal of the cap portion from the body portion of a capsule.

Referring now to FIGS. 4A and 4B, there is shown the cooperative alignment of the body holding ring 26 and superposed cap holding ring 28. In particular, in FIG. 4A body holding ring 26 includes a series of body cavities 52 which are formed to the corresponding shape of the body portion 14 of capsule 12. In the bottom of body cavity 52 is an orifice 54 which may be coupled to a vacuum line (not shown). Cap holding ring 28 includes a cap cavity 56 formed to correspondingly allow passage of the body portion therethrough and to correspondingly receive the cap portion 16 of capsule 12.

Cap cavity 56 further includes a lip 58 which extends sufficiently from the side wall 60 of cap cavity 56 to engage leading edge 17 of cap portion 16. The lip extends a distance from the side wall 60 so that it does not, however, impede insertion of body portion 14 into body cavity 52. Preferably, the extension of lip 58 appropriately matches the diameter of body cavity 52 as shown in FIG. 4A. As further shown in FIG. 4A, the relative depth of body cavity 52 and cap cavity 56 are so as to respectively accommodate the length of preassembled capsule 12 comprised of the body portion 14 and cap portion 16. As shown in FIG. 4A, the capsule 12 and its respective body portion 14 and cap portion 16 are seated in the cap cavity 56 and body cavity 52, respectively.

It can be appreciated with reference to FIG. 4B, that the cap holding ring 28 is removably coupled to the body holding ring 26 so that the cap holding ring 28 can be lifted and lowered into contact with body holding ring 26, with the respective cavities in alignment. The cap holding ring 28 can be lifted and lowered generally in the direction of arrow 62 through a manual operation performed by the user. A vacuum line (not shown) is attached to orifice 54 to create a vacuum for retaining and holding body portion 54 when cap holding ring 28 is lifted away from body holding ring 26. When such lifting action occurs, the lip 58 engages the leading edge 17 of cap portion 16 and slides or lifts the cap portion 16 off of the body portion 14 and removes cap portion 16 therefrom, while body portion 14 is securely held within body holding ring 26.

Figure 5:
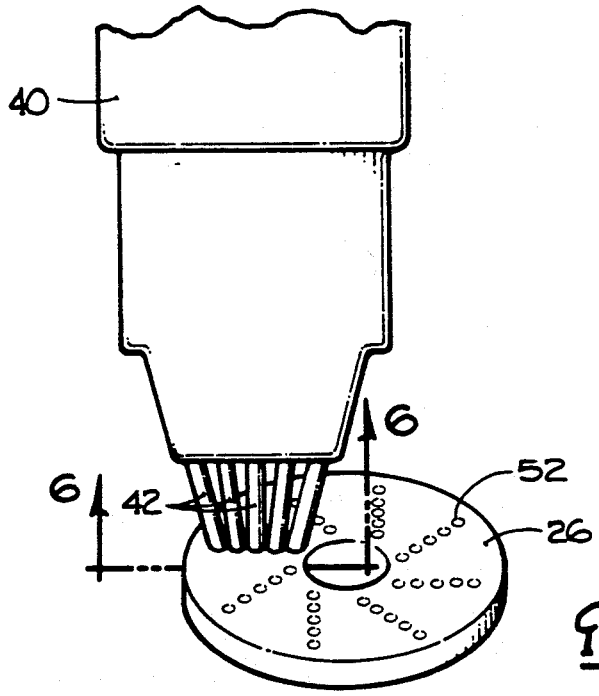
FIG. 5 is a perspective view of a body holding ring beneath a caplet filler in accordance with the present invention.
Figure 6:
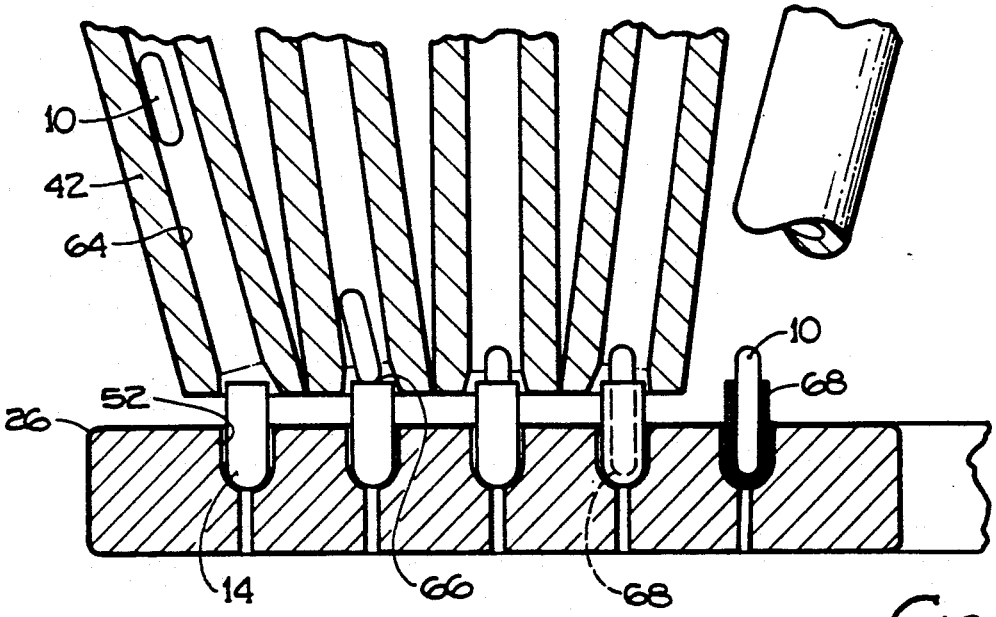
FIG. 6 is a cross-sectional view of the body holding ring and portion of the caplet filler taken along line 6—6 of FIG. 5 schematically illustrating filling of the capsule body portion with a caplet.

Referring now to FIG. 5, and cross referencing FIG. 1, the body holding ring 26 containing a plurality of empty capsule body portions 14 (not shown in FIG. 5) in rows of body cavities 52 is placed on the rotary table, as shown in FIG. 1, beneath the juxtaposed chutes 42 and associated release gates 43 which are in alignment with respective rows of body cavities 52. FIG. 6 shows in further detail the operative cooperation of the release gate 43 with the body holding ring 26. In particular, body holding ring 26 has each of its body cavities 52 holding the empty capsule body portions 14. Each gate 43 has a passageway 45 connected to caplet hopper 40 to allow passage of caplet 10 down through the passageway 45 so that caplet 10 enters the open end 66 of empty body portion 14. The caplet 10 slides into body portion 14 and is seated 68 as shown in FIG. 6. For purposes of illustration and explanation of the present invention, caplets 10 are shown sequentially filling body portions 14. In actual operation, however, sequential operation is not necessarily contemplated and is more likely to be random or closer to simultaneous filling. More specifically, the caplet hopper 40 releases caplets continuously into chute 42. To sequentially release caplets into body holding ring 26, however, the release gate 43 is attached to each of the chutes 42. As can be appreciated in reference to FIG. 5, release gate 43 has a plurality of capsule passageways 45 which align with each of the passageways 64 of the respective chutes 42. Each release gate 43 in turn engages with a release lever , or any similar actuator commonly used in the related art, (not shown) on body holding ring 26 as ring 26 rotates to release one capsule for each increment of rotation of body holding ring 26 so that each row of body cavities 52 are filled, essentially a row at a time, until body holding ring 26 is full of caplet filled body portions 68.

Referring now to FIG. 7, the capsule closing assembly 44 is shown in more detail comprising a housing 70 and an air cylinder 72 for holding cap holding ring 28 and body holding 26 with the respective cap cavities 56 and body cavities 52 in alignment. Also included is a closing cover 74 which is swingably mounted on a cover arm 76 to allow the closing cover 74 to be placed in the closed position over body holding ring 26 once the body holding ring has been placed in alignment against the cap holding ring 28 on air cylinder 72, as shown in closed position 78 in FIG. 1.

As shown in further detail in FIGS. 8A, 8B and 8C, the capsule closing assembly 44 may be operated to place cap portion 16 onto the body portion 14. In particular, in FIG. 8A there is shown the capsule filling ring 24 when separated for placement onto capsule closing assembly 44. Depicted in FIG. 8A as part of ring 24 is the body holding portion 26 containing the body portions 14 in body cavity 52, the body portions 14 each being filled with a caplet 10. In addition, the cap holding ring 28 has positioned therein the empty cap portions 16 within each cap cavity 56. In each filling operation, the body holding ring 26 and the cap holding ring 28 are manually and carefully placed on the capsule closing assembly 44. Such careful placement will ensure that respective holding rings 26 and 28 are tilted only slightly, if at all, past the vertical position depicted in FIGS. 8A–8C. Hence, the component of gravitational force exerted on capsule portions 14 and 16, which is parallel to the capsule cavities, will not overcome frictional forces between portions 14 and 16 and rings 26 and 28, respectively. A mechanism is provided, but not shown, which prevents cap portion 16 from sliding out of the cap cavity 56 when the body portion 14 is inserted into cap portion 16 thereby replacing cap portion 16 onto body portion 14. As shown in FIG. 8B, the body holding ring 26, having the respective cavities 52, 56 in proper alignment, is placed against cap holding ring 28 to replace cap portion 16 onto body portion 14 and thereby close the capsule 12 about caplet 10. Once this proper seating has occurred, cover 74 is rotated away from body holding ring 26, thus leaving caplet filled capsules 12 seated as shown in FIG. 8C. Closing pins (not shown) may then be inserted through orifices 54 to push caplet filled capsules 12 out of cap ring 28 and body ring 26. The filled capsules 12 then fall into the vibrator feeder cleaner 45 positioned beneath the capsule closing assembly as shown in FIG. 2 for appropriate packaging.

In operation of the caplet filling device 20, the operator places the body holding ring 26 and cap holding ring 28 onto the rotary table shown in FIG. 2 and operates the capsule rectifier 32 to fill the assembled capsule filling ring 24. The rotary table incrementally rotates the capsule filling ring 24 (body holding ring 26 and cap holding ring 28) filling the cavities 30 sequentially, row-by-row with preassembled empty capsules as shown in FIGS. 3 and 4A. The operator then activates the vacuum line to retain empty body portion 14 in body cavity 52, and then manually lifts cap holding ring 28 from body holding ring 26 to remove cap portion 16 from each empty body portion 14. Body holding ring 26, which holds the empty body portions 14, is then placed on the rotary table beneath caplet feeding chutes 42, as shown in FIG. 2. Caplets 10 are sequentially conveyed into empty body portions 14, with the body holding ring 26 being incrementally rotated to fill the entire body holding ring 26 row-by-row. In the meantime, cap holding ring 28 containing the cap portions 16 in each cap cavity 56 is placed into body holding ring 26 to align cap portions 16 onto caplet filled body portions 14. The filled body holding ring 26 and cap holding ring 28 together are then loaded onto air cylinder 72, and the capsule closing assembly 44 has the cover 74 placed thereon. The machine is activated by the operator to press rings 26 and 28 together to close capsule 12 as shown in FIG. 8B. Closing pins (not shown) are then inserted through orifices 54 to push caplet filled capsules 12 out of cap ring 28 and body ring 26 as shown in FIG. 8C. The caplet filled capsules 12 then fall down into the vibrator feeder cleaner 45 for subsequent packaging.

Thus, it can be seen that the present invention conveniently and easily allows filling of gelatin capsules with caplets in a manner and at a production rate which allows a cost efficient capsule filling operation. In addition, the device is convenient and easy for the operator to utilize and is relatively inexpensive to manufacture.

While the particular automatic caplet filler as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as defined in the appended claims.

What is claimed is:

1. An apparatus for filling a preassembled empty capsule with a solid substance, said capsule having a body portion and a cap portion, comprising:

a base;

a capsule filling ring rotatably and removably mounted on said base, said capsule filling ring having a cavity for receiving said capsule and being manually repositionable on said base;

a capsule rectifier mounted on said base and associated with said capsule filling ring for placing said capsule in a specified orientation into said cavity in said capsule filling ring;

means attached to said base and positionable with said capsule filling ring for removing said cap portion of said capsule from said empty body portion;

a filler mounted on said base and positionable with said capsule filling ring for filling said empty body portion with a substance; and means attached to said base and positionable with said capsule filling ring for placing said removed cap portion onto said body portion containing said substance to join said cap and body portions together.

2. An apparatus for filling a preassembled empty capsule with a solid substance, said capsule having a body portion and a cap portion as recited in claim 1, wherein said capsule filling ring comprises a capsule body holding ring having a body cavity, and a superposed cap holding ring having a cap cavity in alignment with said body cavity, for receiving said preassembled capsules.

3. An apparatus for filling a preassembled empty capsule with a solid substance, said capsule having a body portion and a cap portion as recited in claim 2, wherein said means for removing said cap portion from said body portion comprises said body holding ring having body retaining means associated with said body cavity for retaining said capsule body portion, and said cap holding ring having cap lifting means associated with said cap cavity for removing said cap portion.

4. An apparatus for filling a preassembled capsule with a solid substance, said capsule having a body portion and a cap portion as recited in claim 3, wherein said body retaining means comprises an orifice in the bottom of said cavity.

5. An apparatus for filling a preassembled empty capsule with a solid substance, said capsule having a body portion and a cap portion as recited in claim 4, wherein said cap retaining means comprises a lip formed in said cavity for engaging said cap portion.

6. An apparatus for filling a preassembled empty capsule with a solid substance, said capsule having a body portion and a cap portion as recited in claim 5, wherein said body holding ring and said cap holding ring include a plurality of said body cavities and cap cavities, respectively, said plurality of cavities being arranged in a series of substantially straight rows, each said row being positioned parallel to a radius of said body holding ring.

7. An apparatus for filling a preassembled empty capsule with a solid substance, said capsule having a body portion and a cap portion as recited in claim 1, wherein said base includes a rotary table and said capsule filling ring comprises a body holding ring having body cavities and mountable on said rotary table, and wherein said filler comprises a hopper for holding a plurality of portions of said substance, with a plurality of juxtaposed chutes extending from said hopper for conveying each of said portions of said substance into said empty body portion sequentially row-by-row upon incremental rotation of said body holding ring.

8. An apparatus for filling a preassembled empty capsule with a solid substance, said capsule having a body portion and a cap portion as recited in claim 7, wherein said capsule filling ring includes a body holding ring having a plurality of body cavities for holding a plurality of capsule body portions, said body cavities being arranged in alignment with said hopper chutes.

9. An apparatus for filling a preassembled empty capsule with a solid substance, said capsule having a body portion and a cap portion as recited in claim 8, wherein said hopper chutes are arranged in a series of substantially straight rows, and said body cavities are arranged in a series of substantially straight rows, each said row being parallel to a radius of said body holding ring.

10. An apparatus for filling a plurality of preassembled empty capsules with a caplet, each said capsule having a body portion and a cap portion, comprising:

a base;

a body holding ring rotatably and removably mounted on said base, wherein said body holding ring is manually repositionable on said base, said body holding ring having a plurality of body cavities for receiving said body portion;

a cap holding ring having a plurality of corresponding cap cavities, said cap holding ring being superposed over said body holding ring and associated therewith for receiving said cap portion;

a capsule rectifier mounted on said base and associated with said cap holding ring and said body holding ring for placing said capsules in a specified orientation into said body cavities and said cap cavities;

retaining means associated with said body holding ring for retaining said body portion in said cavity, and removing means associated with said cap holding ring for removing said cap portion from said retained body portion;

a caplet filler mounted on said base and positionable with said body holding ring for filling said empty body portion with a caplet; and closing means attached to said base for placing said removed cap portion onto said retained body portion filled with a caplet to create an assembled capsule filled with a caplet.

11. An apparatus for filling a plurality of preassembled empty capsules with a caplet, each said capsule having a body portion and a cap portion as recited in claim 10, wherein said retaining means comprises an orifice in the bottom of each said body cavity.

12. An apparatus for filling a plurality of preassembled empty capsules with a caplet, each said capsule having a body portion and a cap portion as recited in claim 10, wherein said lifting means comprise said cap cavity including a lip for engaging said cap portion when said cap holding ring is lifted from said body holding ring.

13. An apparatus for filling a plurality of preassembled empty capsules with a caplet, each said capsule having a body portion and a cap portion as recited in claim 10, wherein said caplet filler includes a hopper for holding a plurality of said caplets, and a plurality of juxtaposed chutes extending from said hopper for conveying said caplets into said empty body portions.

14. An apparatus for filling a plurality of preassembled empty capsules with a caplet, each said capsule having a body portion and a cap portion as recited in claim 13, wherein said plurality of body cavities are arranged on said body holding ring in a series of substantially straight rows positioned parallel to a radius of said body holding ring for conveying said caplets from said chutes into said empty body portions sequentially row-by-row upon rotation of said body holding ring.

15. An apparatus for filling an empty capsule having a body portion and a cap portion, with a caplet, comprising:

capsule holding means for holding a plurality of said preassembled capsule body portions and cap portions in a series of substantially straight rows;

means for incrementally rotating said capsule holding means;

capsule rectifier means removably attached to said capsule holding means for placing said capsules in a specified orientation into said capsule holding means, a row at a time, upon incremental rotation of said capsule holding means;

separating means removably attachable to said capsule holding means for removing said cap portion from said empty body portion;

caplet filling means removably connected to said capsule holding means for filling said empty body portion with a caplet, row-by-row upon incremental rotation of said capsule holding means; and closing means removably connected to said capsule holding means for replacing said removed cap portion onto said body portion filled with a caplet.

16. A method for filling an empty capsule having a body portion and a cap portion with a solid substance, comprising the steps of:

(A) Orienting a plurality of preassembled capsule body portions and cap portions in individual rows of a holding ring, wherein said holding ring comprises a first piece and a second piece;

(B) Removing said cap portions from said body portions by separating said first and said second pieces of said holding ring;

(C) Incrementally moving said individual rows of body portions to sequentially move said rows into a filling position;

(D) Simultaneously inserting portions of said substance into said body portions in said row at said filling position; and (E) Respectively covering said plurality of filled body portions with a plurality of said cap portions by pressing said first and said second pieces of said holding ring together.

* * * * *